United States Patent [19]

Dills

[11] 3,982,096

[45] Sept. 21, 1976

[54] BAKING OVEN WITH TWO-SIDED BROILING

[75] Inventor: Raymond L. Dills, Louisville, Ky.

[73] Assignee: General Electric Company, Louisville, Ky.

[22] Filed: Jan. 2, 1976

[21] Appl. No.: 646,411

[52] U.S. Cl. ..... 219/403; 99/340; 219/396; 219/404

[51] Int. Cl.[2] ..... F27D 11/02

[58] Field of Search ..... 219/395, 396, 397, 403, 219/404, 410, 447; 99/340

[56] References Cited

UNITED STATES PATENTS

| | | | |
|---|---|---|---|
| 2,836,697 | 5/1958 | Jordan | 219/404 X |
| 3,086,102 | 4/1963 | Meyers | 219/404 |
| 3,270,660 | 9/1966 | Filipak | 99/340 |
| 3,281,575 | 10/1966 | Ferguson, Jr. | 219/404 |
| 3,522,414 | 8/1970 | Kramar | 219/404 |
| 3,548,154 | 12/1970 | Christiansson | 219/403 |
| 3,578,949 | 5/1971 | Weyrick | 219/403 |

*Primary Examiner*—Volodymyr Y. Mayewsky
*Attorney, Agent, or Firm*—Richard L. Caslin; Francis H. Boos

[57] ABSTRACT

An electric baking and broiling oven with an upper broiling element adjacent the top wall and a lower baking element adjacent the bottom wall. The baking element is of unique design having vertically arranged terminal ends supporting a plug connector. A mating plug receptacle is located in the rear wall of the oven liner slightly below the mid-height to receive the plug connector of the baking element.

The baking element is reversible, in that its plug connector may be inserted in the plug receptacle upside down, so the baking element can be inverted and arranged closely spaced from and parallel to the upper broiling element. Both heating elements are to be energized during broiling. A shelf is positioned between the two heating elements so food placed thereon may be broiled on both top and bottom sides simultaneously.

8 Claims, 3 Drawing Figures

BAKING OVEN WITH TWO-SIDED BROILING

BACKGROUND OF THE INVENTION

1. Field of the Invention:

This invention relates to electric ovens for both baking and broiling foods, and particularly to ovens capable of broiling food on both sides simultaneously.

2. Description of the Prior Art:

Most electric ranges having combined baking and broiling ovens. In such ovens, food may either be baked using a lower baking element at full wattage and an upper broiling element at one-quarter wattage, or food may be broiled using only the upper broiling element at full wattage. One disadvantage in such broiling operations is that the food must be turned over midway in the operation so both top and bottom sides are broiled.

Prior attempts have been made to perform two-sided broiling. The Filipak U.S. Pat. No. 3,270,660 describes a baking and broiling oven with a top broiling element and a bottom plug-in baking element. An additional plug receptacle is mounted in the back wall of the oven liner near the mid-height thereof so the lower baking element may be unplugged from the lower receptacle and assembled in the intermediate plug receptacle to provide two-sided broiling. A modification in this patent suggests the use of a third heating element to be used with the intermediate plug receptacle to serve as a lower broiling element.

Another prior art patent is Kramer U.S. Pat. No. 3,522,414, which is assigned to the present assignee. This Kramer patent describes a baking and broiling oven with standard upper broiling element and lower baking element. There is a third heating element provided with terminal means pivotally mounted to the opposite side walls of the oven liner so this third heating element may be stored in an inoperative vertical position against the rear wall of the oven liner, or this third element may be raised to a horizontal position to serve as a lower broiling element of a two-sided broiling system.

The principal object of the present invention is to provide a combined baking and broiling oven with a two-sided broiling feature while using only two heating elements and no additional plug receptacles.

A further object of the present invention is to provide a baking and broiling oven of the class described wherein the lower baking element is convertible into a second broiling element without using an additional plug receptacle.

A still further object of the present invention is to provide a two-sided broiling system without requiring additional heating elements or separate supporting means for the lower broiling element so as not to complicate the cooking utensil storage problem that exists in the kitchen.

SUMMARY OF THE INVENTION

The present invention, in accordance with one form thereof, relates to a combined baking and broiling oven with a standard upper broiling element and a reversible lower baking element that is convertible into a second broiling element. The baking element has right angular terminals with a plug connector and receptacle located just below the mid-height of a vertical wall of the oven liner. In one position of the baking element, it is located adjacent the bottom wall of the oven liner, and in an inverted position, it is spaced parallel to the upper broiling element to provide a simultaneous top and bottom broiling action.

BRIEF DESCRIPTION OF THE DRAWINGS

This invention will be better understood from the following description taken in conjunction with the accompanying drawings, and its scope will be pointed out in the appended claims.

DESCRIPTION OF THE PREFERRED EMBODIMENT

Figure 1:
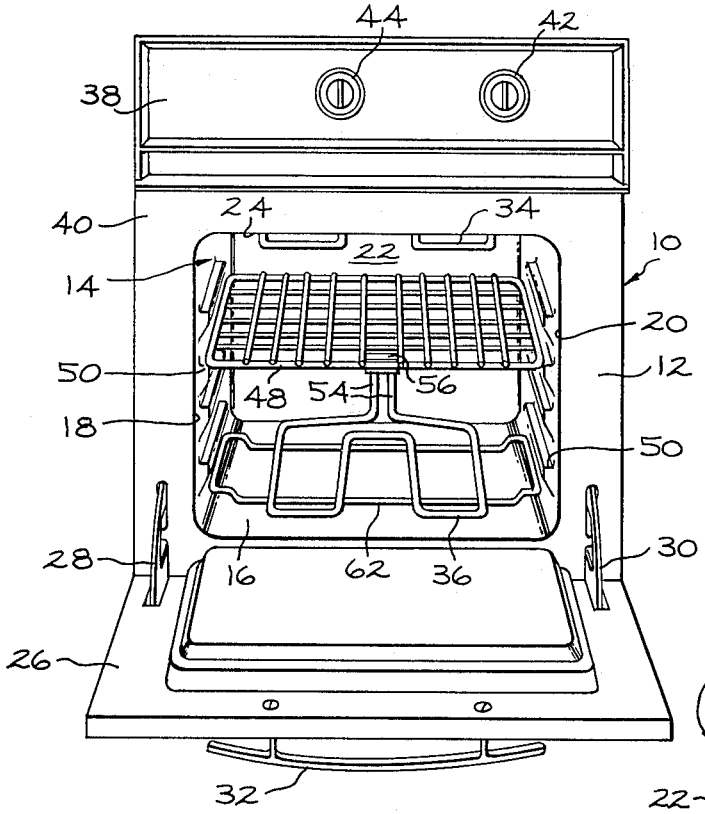
FIG. 1 is a front elevational view of an electric oven with its door in the open position showing a standard upper broiling element and a reversible baking element of the present invention shown in its lower baking position.

Turning now to a consideration of the drawings, and in particular to FIG. 1, there is shown for illustrative purposes a built-in wall oven 10 that is furnished with the two-sided broiling feature of the present invention. This invention is usable in electric ovens in general, whether they are built into the kitchen wall or are furnished as part of an electric range in combination with a surface cooktop. The oven 10 has an oven body or outer cabinet structure 12 in which is assembled a box-like oven liner 14 having a bottom wall 16, opposite vertical side walls 18 and 20, a vertical rear wall 22, as well as a top wall 24. The front of the oven liner 14 is open and it is adapted to be closed by an access door 26. The door is supported by a pair of hinge straps 28 and 30 that are arranged at the lower corners of the door to have a hinge axis extending along the bottom edge of the door. A door handle 32 is located adjacent the top edge of the door.

The oven cooking cavity includes an upper broiling element 34 adjacent the top wall 24 and a lower baking element 36 adjacent the bottom wall 16 of the oven liner. A control panel 38 is shown arranged above the top edge of the front frame 40 of the oven cabinet 12. The heating elements 34 and 36 are controlled by a selector switch 42 and an oven thermostat 44 that are mounted in the control panel 38.

The oven is furnished with at least one shelf 48 of open, welded wire construction with closely spaced criss-crossed pattern so that food may be supported directly thereon and broiled from above and below. A series of vertically spaced embossments or ledges 50 are formed on each side wall 18 and 20 of the oven liner to serve as shelf support means so the shelf may be adjusted in elevation, at will.

Both heating elements 34 and 36 are metal sheathed electrical resistance heating elements of looped configuration, generally as shown for the lower baking element 36. The upper broiling element 34 may be a standard broiling element that has electrical terminal means (not shown) that extend out through the rear wall 22 of the oven liner.

The lower baking element 36 is designed to be reversible within the oven cavity. The baking element 36 has a first baking position shown in FIG. 1 adjacent the bottom wall 16 of the oven liner, and a second broiling position shown in FIGS. 2 and 3 closely spaced from and generally parallel to the upper broiling element 34.

The baking element 36 has a pair of vertical electrical terminal ends 54 which are arranged adjacent the rear wall 22 of the oven liner. A plug connector 56 is fitted on the tips of the terminal ends 54. When the baking element 36 is in its baking position of FIG. 1, the plug connector 56 is located at an elevation slightly below the mid-height of the rear wall 22. In one modification of this invention, if the oven liner 14 is 15 inches high, then the center of the plug connector 56 is between 4 and 6 inches above the bottom wall 16 of the oven liner. A plug receptacle 58 is mounted on the rear wall 22 to receive the plug connector 56 and to make an electrical connector therebetween. While the plug connector 56 and plug receptacle 58 are shown at the rear wall 22 of the oven liner, they could also be mounted in either side wall 18 or 20.

As shown in FIG. 1, a looped wire frame 62 is fastened across the underside of the baking element 36. This frame 62 rests upon the bottom wall 16 and thereby spaces the baking element 36 off of the bottom wall and avoids forming hot spots on the porcelain enamel coating of the bottom wall.

Figure 3:
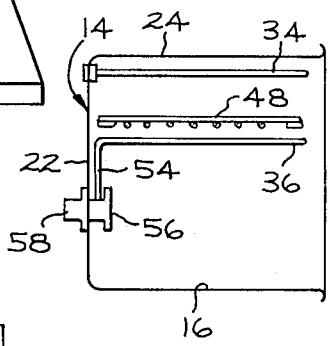
FIG. 3 is a fragmentary block diagram of a cross-sectional side elevational view of the oven taken on the line 3—3 of FIG. 2 to better show the vertical relationship between the two broiling elements and the intermediate shelf, as well as the elevated location of the plug connector and plug receptacle for the reversible baking element.
Figure 2:
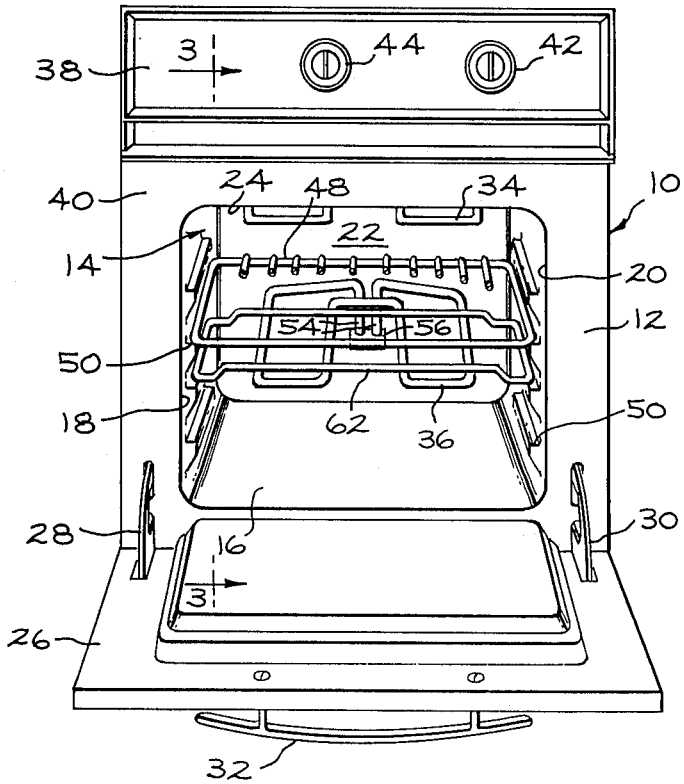
FIG. 2 is another front view of the oven of FIG. 1 showing the reversible baking element in its inverted position to be closely spaced from the upper broiling element and parallel thereto. There is a fragmentary showing of an oven shelf interposed between the two broiling elements to support food directly thereon so both the top and bottom sides of the food may be broiled simultaneously.

It is possible to unplug the baking element 36 from the plug receptacle 58 and then turn it completely over and reconnect it into the same plug receptacle into the elevated broiling position shown in FIGS. 2 and 3. The main weight of the inverted baking element 36, now the second broiling element, is carried by the frame 62 which extends to the opposite side walls 18 and 20 and rests upon the embossments or ledges 50 in a manner similar to the shelf 48. The vertical spacing between the two broiling elements 34 and 36 in FIGS. 2 and 3 is about 4 inches. The oven shelf 48 is positioned between the two broiling elements for supporting a food to be broiled. Since the upper broiling element 34 is backed-up by the top wall 24, most of its heat energy is radiated downwardly. The lower broiling element 36 in FIG. 3 is in free space and its heat energy radiates both up and down so less of its heat energy reaches the food on the overhead shelf 48. Thus, to obtain generally uniform broiling results, the shelf 48 is positioned closer to the lower broiling element 36 than to the upper broiling element 34.

In a baking mode, the oven of the present invention is heated in a conventional manner. The baking element 36 of FIG. 1 is energized at 240 volts AC at full wattage of about 3000 watts. At the same time, the upper broiling element 34 is energized at 120 volts AC at one-quarter wattage of about 750 watts.

In the broiling mode of a standard electric oven, the broiling element is energized at 240 volts AC at full wattage of about 3000 watts.

In the broiling mode of the present invention of FIGS. 2 and 3, both broiling elements 34 and 36 are energized in a parallel 240-volt circuit at full wattage of about 3000 watts each. This invention greatly increases the speed of broiling, it eliminates the need for turning the food over halfway in the broiling operation, it performs two-sided broiling with only two oven heating elements and without creating a storage problem in the kitchen.

Modifications of this invention will occur to those skilled in this art. Therefore, it is to be understood that this invention is not limited to the particular embodiments disclosed, but that it is intended to cover all modifications which are within the true spirit and scope of this invention as claimed.

I claim:

1. A baking and broiling oven comprising:
   - an oven cooking cavity formed by a box-like oven liner and a front-opening access door;
   - vertically adjustable shelf means for supporting food at various elevations within the oven cooking cavity;
   - electrical resistance heating means for the oven including an upper horizontal broiling element located adjacent the top wall of the oven liner, and a lower horizontal baking element located adjacent the bottom wall of the oven liner;
   - the invention comprising the baking element having vertical terminal means arranged adjacent a vertical wall of the oven liner, the terminal means having an electrical plug connector arranged at an elevation slightly below the mid-height of the vertical wall, and an electrical plug receptacle mounted in the said vertical wall at an elevation slightly below the mid-height of the vertical wall for receiving the plug connector and making an electrical connection therebetween.
   - the plug connector being reversible in the plug receptacle so the baking element may be arranged closely parallel to the upper broiling element for performing a simultaneous two-sided broiling operation;
   - and support means for holding the baking element in the reversible elevated position.

2. The invention of claim 1 wherein the said support means comprises a framework which is supported from the walls of the oven liner.

3. The invention of claim 1 wherein the said support means comprises a frame which is carried by the baking element and rests upon shelf support means at the sides of the oven liner.

4. The invention of claim 3 wherein at least a portion of the said support frame underlies the baking element in its lower baking position so as to support the baking element off of the bottom wall of the oven liner.

5. The invention of claim 1 wherein the said electrical plug receptacle is located in the back wall and about five inches above the bottom wall of the oven liner, and in the reversible elevated position of the baking element the two upper broiling elements are spaced apart in a range between 3 and 7 inches.

6. The invention of claim 5 wherein the said shelf means is positioned between the two upper broiling elements for the two-sided broiling operation, the shelf means being of open wire construction that is closely spaced to support food directly thereon, the shelf means being positioned closer to the lower broiling element so as to substantially equalize the heating effect from the two broiling elements and obtain generally uniform browning of the food.

7. The invention of claim 1 wherein both heating elements are of substantially equal wattage, and both elements are energized at full wattage during the two-sided broiling operation.

8. The invention of claim 7 wherein during the baking operation the lower heating element is located adjacent the bottom wall of the oven liner and is energized at full wattage, while at the same time the upper broiling element is energized at one-quarter wattage.

* * * * *